US007861859B2

(12) United States Patent
Reynolds et al.

(10) Patent No.: US 7,861,859 B2
(45) Date of Patent: Jan. 4, 2011

(54) PLUNGER STORAGE AND TRANSPORTATION DEVICE

(76) Inventors: Rob Reynolds, 3913 English Oak Cir., Lexington, KY (US) 40514; Jim Reynolds, 2227 Bourbon St., Union, KY (US) 41091

( * ) Notice: Subject to any disclaimer, the term of this patent is extended or adjusted under 35 U.S.C. 154(b) by 0 days.

(21) Appl. No.: 12/249,146

(22) Filed: Oct. 10, 2008

(65) Prior Publication Data

US 2009/0095646 A1 Apr. 16, 2009

Related U.S. Application Data

(60) Provisional application No. 60/979,689, filed on Oct. 12, 2007.

(51) Int. Cl.
*A45C 11/26* (2006.01)
*E03D 11/00* (2006.01)

(52) U.S. Cl. ..... 206/349; 206/361; 206/372; 4/355.05

(58) Field of Classification Search ..... 206/361, 206/349, 372, 15.3; 4/255.11, 225.01–255.05; D6/524
See application file for complete search history.

(56) References Cited

U.S. PATENT DOCUMENTS 4,679,700 A 7/1987 Tharrington et al.
D292,631 S * 11/1987 Tash ..... D32/14
4,831,669 A 5/1989 Edwards
D315,269 S 3/1991 Brazis
5,114,006 A 5/1992 Wilk
D329,561 S * 9/1992 Nyorkor ..... D6/525
D355,553 S * 2/1995 Tiramani ..... D6/525
D362,575 S 9/1995 Bird et al.
5,456,356 A 10/1995 Kurzawa
D370,376 S 6/1996 Mifsud
D383,935 S 9/1997 Zawalsky
D400,748 S 11/1998 France
5,836,322 A 11/1998 Borger et al.
5,924,566 A 7/1999 Gibbs
5,941,379 A 8/1999 Barardo
D413,470 S 9/1999 Burton
5,958,150 A 9/1999 Borger et al.
5,971,141 A 10/1999 Shafik
5,984,100 A 11/1999 Ramsey et al.
D419,019 S 1/2000 Shafik
D419,348 S 1/2000 Speceal
D419,806 S 2/2000 Shafik
6,035,456 A 3/2000 Taylor
6,038,709 A * 3/2000 Kent ..... 4/255.05
D423,844 S 5/2000 Bruns et al.
D425,744 S 5/2000 McGuire
6,055,680 A 5/2000 Tolbert (Continued)

*Primary Examiner*—Ehud Gartenberg
*Assistant Examiner*—Ernesto A Grano
(74) *Attorney, Agent, or Firm*—Wood, Herron & Evans, L.L.P.

(57) ABSTRACT

A plunger storage and transportation device that is adapted to store, hold, and secure, and is capable of storing, holding, and securing, many different sizes, shapes, and styles of plungers. The plunger storage and transportation device includes structure that secures at least the plunger head within a housing. The device can be easily transported from one location to another while securing a plunger in a contained, clean, and easy manner. Accordingly, the plunger storage and transportation device may be used with, and can transport, a multitude of different plungers produced by a wide variety of plunger manufacturers, and therefore not be limited to one type or size of plunger.

8 Claims, 5 Drawing Sheets

U.S. PATENT DOCUMENTS 6,109,429 A 8/2000 Cunningham et al.
6,193,059 B1 2/2001 Massaro
6,241,091 B1 6/2001 Moore et al.
D449,951 S 11/2001 Schmidt et al.
D450,895 S 11/2001 Poston
D450,964 S 11/2001 Johnson
D452,401 S 12/2001 Schmidt et al.
6,383,457 B1 5/2002 Brown
D458,068 S 6/2002 Hillman
6,446,792 B1 9/2002 Kaniaris, Jr.
D463,698 S 10/2002 Phillips et al.
D466,661 S 12/2002 Schmidt et al.
D471,393 S 3/2003 Hutchinson
D477,483 S 7/2003 Brown et al.
6,601,700 B1 8/2003 Rudnick et al.
D483,590 S * 12/2003 Dretzka ..... D6/551
6,719,134 B2 4/2004 Phillips et al.
6,769,542 B2 8/2004 Polito
6,779,202 B1 8/2004 Alldredge
6,813,785 B1 11/2004 Baker
6,883,189 B2 4/2005 Pierce
6,951,281 B1 10/2005 Jeffery
7,058,993 B2 6/2006 Nasco
7,089,605 B2 8/2006 Jiang
7,156,476 B2 1/2007 Helber
7,185,759 B2 3/2007 Rich
D545,600 S 7/2007 Curtis
7,578,412 B2 * 8/2009 Clamage ..... 220/771
2002/0100705 A1 8/2002 Phillips et al.
2002/0125168 A1 9/2002 Kaniaris, Jr.
2003/0168364 A1 9/2003 Watlington
2003/0178430 A1 9/2003 Wentz et al.
2003/0209458 A1 11/2003 Kaminstein
2004/0036385 A1 2/2004 Connerton
2004/0107488 A1 6/2004 Brown et al.
2004/0117900 A1 6/2004 Pierce
2005/0028258 A1 2/2005 Nasco
2005/0173277 A1 8/2005 Rich
2005/0252804 A1 11/2005 Leaphart, Jr. et al.
2006/0065568 A1 * 3/2006 Yourist ..... 206/519
2006/0123531 A1 6/2006 Karlicek
2006/0138002 A1 6/2006 Gillissie et al.
2006/0213791 A1 9/2006 Holden
2006/0213792 A1 9/2006 Nguyen et al.
2007/0094779 A1 5/2007 Dauphin
2007/0192950 A1 8/2007 Anderson

* cited by examiner

PLUNGER STORAGE AND TRANSPORTATION DEVICE

CROSS REFERENCE TO RELATED APPLICATION

The present application claims benefit of U.S. Provisional Patent Application No. 60/979,689, entitled "Plunger Storage and Transportation Device," filed Oct. 12, 2007 by the same inventors of the present application, the disclosure of which is hereby incorporated herein by reference in its entirety.

FIELD OF THE INVENTION

This invention relates generally to the field of plumbing plunger storage and transportation devices, and more specifically relates to plunger storage and transportation devices that accept and hold a variety of manufactured plungers of varying sizes and shapes.

BACKGROUND

This section is intended to introduce the reader to various aspects of art that may be related to various aspects of the present invention, which are described and/or claimed below. This discussion is believed to be helpful in providing the reader with background information to facilitate a better understanding of various aspects of the present invention. Accordingly, it should be understood that these statements are to be read in this light, and not as admissions of prior art.

Households, stores, and industries usually have a plumbing plunger for use in the event of a blockage in a drain (e.g., in a toilet, sink, etc.) Such plungers are also kept by the plumbing industry, and can be of many varying sizes. A typical plunger generally includes a head in the shape of a cup (usually made of a flexible material, such as rubber or plastic) and an elongate, rigid shaft attached to, and extending from, the plunger head. In use, the plunger head is pushed down against a drain, and either pressed hard into the drain to force air in, or is pushed down until the head is flattened, and then pulled out, causing a vacuum. The intent is to loosen or break up a clog, excessive material, or other blockage. In many households, stores, and other locations, the plunger is stored in open view because of the difficulty of finding a location where a used plunger can be placed without liquid draining from the plunger, thereby causing unsanitary contamination or some other type of damage. Further, many people are reluctant to pick up and transport a plunger to another room after use due to the likelihood of the plunger dripping liquid. In addition, the relatively large size of the typical plunger makes it difficult to store in homes, stores, industries, or other locations that have limited storage space.

Further, when dealing with various drain problems, it is convenient for the plunger to be stored close to the drain. Sometimes drain blockages can result in overflow, causing water damage, odorous contamination, mold formation, bacterial growth, or other types of damage or unsanitary conditions. Because such overflows can happen quickly, storage of the plunger in an easily accessible location is desirous. However, the plunger head is considered unsightly by many, and may be contaminated with materials due to its use. As a result, many homeowners and storeowners do not keep the plunger in an accessible location, but rather keep it out of sight, where it is not easily accessible. Further, when the plunger is kept within reach of a drain, it may be within view of users, customers, etc. and have an unsightly appearance, be malodorous, etc., thereby contributing to the perception of the drain, and perhaps the business itself, as being unsanitary.

Further, plungers are commonly perceived to be unsanitary because it is likely they have come into close contact with unsanitary substances (such as toilet bowl liquids or drain pipe liquids). Consequently, plungers are a habitat for disease germs, and people do not want plungers to be close by or within their view. As a result, the plunger needs to be in an accessible location, but without the unsightly appearance or unsanitary conditions. Further, a problem arises in that plungers may often be needed to be transported from one location to another, but there is no sanitary and rapid manner to store and transport the plunger.

Further, depending on the type, size, and/or location of the drain, different plungers may be employed. These various plungers come in a wide variety of shapes, sizes, and styles. Thus, a business or industry may need to keep several different plunges on hand. However, storage and transportation devices generally do not accept most or all of the wide variety of plunges. Alternatively, if a single size, shape, or styles of plunger is kept in a house, business, industry, etc., it would be laborious to find a storage and transportation device that specifically matches that plunger. Containers for storing and transporting plumbing plungers and related articles have previously been developed. For example, U.S. Pat. No. 6,951,281 (issued to Jeffery on Oct. 4, 2005), U.S. Pat. No. 7,185,759 (issued to Rich on Mar. 6, 2007), U.S. Pat. No. 6,601,700 (issued to Rudnick on Aug. 5, 2003), and U.S. Pat. No. 6,038,709 (issued to Kent on Mar. 21, 2000) disclose plunger storage devices. However, they include drawbacks in that they do not allow for storage and/or transportation of a multitude of plungers produced by a wide variety of manufactures, having varying sizes, shapes, and styles.

SUMMARY OF THE INVENTION

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be explicitly set forth below.

One aspect of the present invention includes a plunger storage and transportation device that is adapted to store, hold, and secure, and is capable of storing, holding, and securing, many different sizes, shapes, and styles of plungers. The device can be easily transported from one location to another while securing a plunger in a contained, clean, and easy manner. Accordingly, the plunger storage and transportation device may be used with, and can transport, a multitude of different plungers produced by a wide variety of plunger manufacturers, and therefore not be limited to one type or size of plunger.

In particular, the plunger storage and transportation device includes structure that secures at least the plunger head within a housing. For example, such structure may include multiple indentations in a housing that assist in securing the plunger in place. Thus, a first embodiment of the plunger storage and transportation device may include a housing having at least one side wall defining an interior compartment, and a plurality of indentations associated with the at least one side wall and extending inwardly into the interior compartment of the housing. The indentations may provide resistance to hold varying plungers, as well as hold the plunger head in place during transport, but also allow for removal of the plunger as the user, using an upward pulling motion while holding the plunger neck, exerts enough pressure on the indentations to remove the plunger. Further, the at least one side wall may taper inwardly from a first end (being an open end through which the plunger is inserted) toward a second end of the housing, the second end being opposite the first end. The taper of the side wall may also, or alternatively, assist in maintaining the plunger head within the housing during storage and/or transport. For example, in a cylindrical device having a tapered side wall, the diameter of the interior compartment will be larger near the first end and smaller near the second end. Thus, plungers having a plunger head of a smaller diameter will be inserted further into the interior compartment (i.e., closer to the second end) before contacting the side wall, than plungers having a plunger head of a larger diameter. The contact force and friction between the side wall and the plunger head may assist in maintaining the plunger head within the housing.

Alternatively, in a second embodiment of the plunger storage and transportation device, the plunger head may be placed within an interior compartment defined by a side wall of a housing, and an opening at a first end of the housing may be closed off by a lid. The housing may include structure that complements the lid in order to ensure that the lid is securely fastened thereto. Thus, the device may include (1) a housing having at least one side wall defining an interior compartment, and an outer rim defining an opening at a first end of the housing, wherein the at least one side wall extends from the first end toward a second end of the housing, the second end being opposite the first end; (2) a plurality of lid retaining members on the at least one side wall and extending inwardly into the interior compartment of the housing; and (3) a flexible and removable lid adapted to confront at least two of the plurality of lid retaining members.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION

Figure 1:
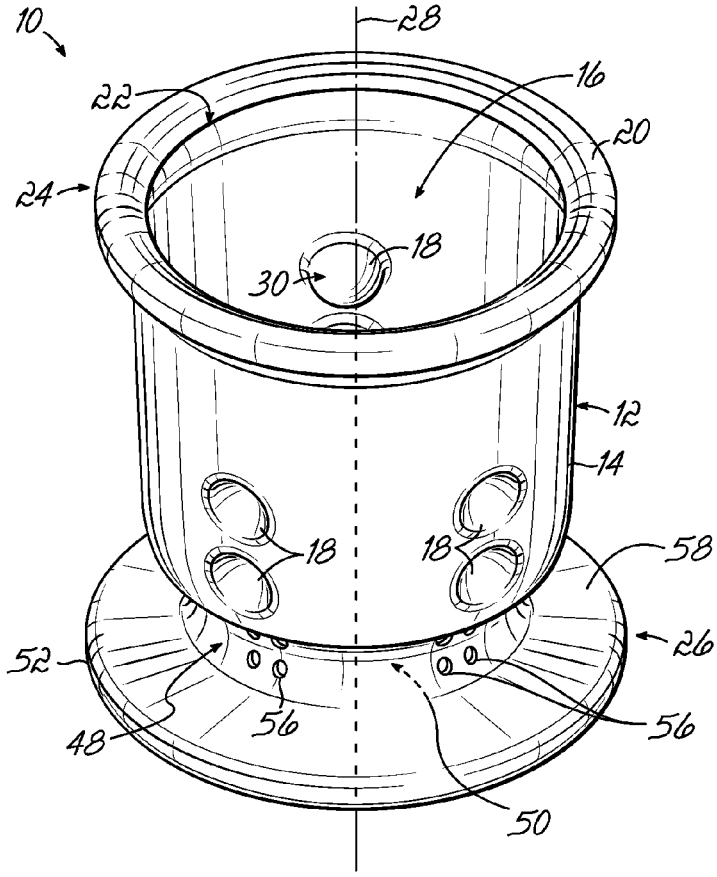
FIG. 1 is a perspective view of a first embodiment of a plunger storage and transportation device made in accordance with the principles of the present invention.

One or more specific embodiments of the present invention will be described below. In an effort to provide a concise description of these embodiments, not all features of an actual implementation may be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring to FIGS. 1-4, a first embodiment of a plunger storage and transportation device 10 in accordance with the principles of the present invention is shown. In particular, the plunger storage and transportation device 10 includes a housing 12 having at least one side wall 14 defining an interior compartment 16, and a plurality of indentations 18 associated with the at least one side wall 14 and extending inwardly into the interior compartment 16 of the housing 12. As will be described in greater detail below, the indentations 18 provide enough resistance to hold varying plungers, as well as hold the plunger head in place during transport, but also allow for removal of the plunger as the user, using an upward pulling motion while holding the plunger neck, exerts enough pressure on the indentations 18 to remove the plunger. Further, the device 10 may include an outer rim 20 defining an opening 22 at a first end 24 of the housing 12, the opening 22 being adapted to receive a plunger head as it is inserted into the interior compartment 16 of the device 10. Further, a portion of the at least one side wall 14 that defines the interior compartment 16 may taper inwardly from a point at or proximal to the first end 24 of the housing 12 toward a second end 26 of the housing 12, the second end 26 being opposite the first end 24. Thus, cross sections of the interior compartment 16 taken perpendicular to a longitudinal axis 28 of the housing 12 grow progressively smaller in area as one moves in a direction from the first end 24 of the housing 10 toward the second end 26 of the housing 10. As will be described in greater detail below, the taper of the side wall 14 also contributes to the ability of the device 10 to accept and retain varying sizes, shapes, and styles of plungers.

More specifically, FIG. 1 shows a perspective view of the plunger storage and transportation device 10. The plunger storage and transportation device 10 includes an outwardly flared rim at, and defining, the top opening 22 at the first end 24 of the device 10 (see also FIGS. 3 and 4). The housing 12, in the illustrated embodiment, has a generally cylindrical shape which is open at the first end 24, and closed at the second end 26, whereby the cylindrical side wall 14 extends from the first end 24 in a direction toward the second end 26 for a distance which is sufficient to accommodate a variety of existing plunger products. Thus, in the illustrated embodiment, the portion of the side wall 14 including the taper defines the interior compartment 16. Further, the taper of the cylindrical side wall 14 is part of the design of the plunger storage and transportation device 10 that allows for acceptance and retention of a number of different sizes of plunger products. When used in combination with the device of the present invention, the plunger may be held within the device 10 due to a contact and confrontation between the plunger head (and particularly the outer edge, e.g., the circumference, thereof) with the interior surface of the side wall 14 of the device 10. Thus, plungers having plunger heads of a smaller diameter or size will be positioned within the interior compartment 16 of the device 10 and closer to the second end of the side wall 14 in order to cause a contact between the plunger head and side wall 14, while plungers of larger diameter or sized plunger heads may be retained nearer the first end of the cylindrical side wall 14 of the device 10.

Figure 2:
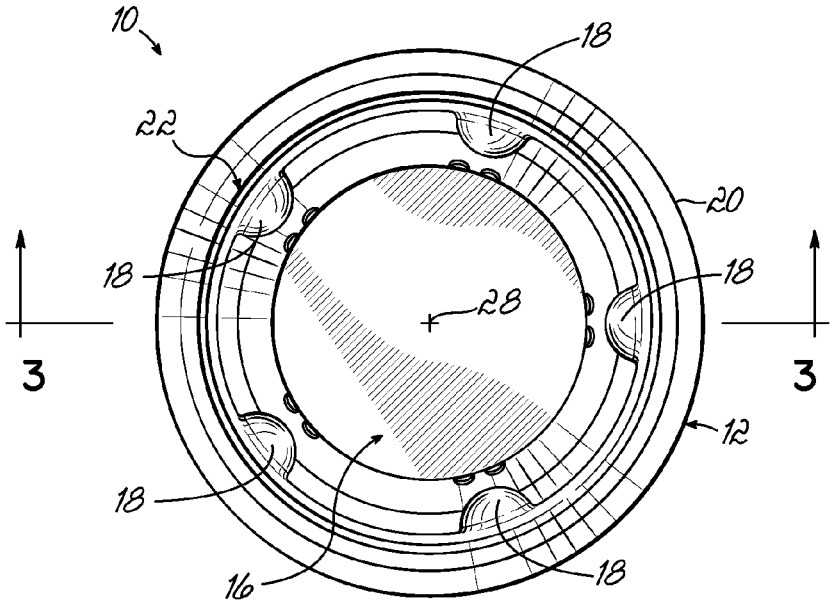
FIG. 2 is a top view of the first embodiment of the plunger storage and transportation device of FIG. 1.
Figure 3:
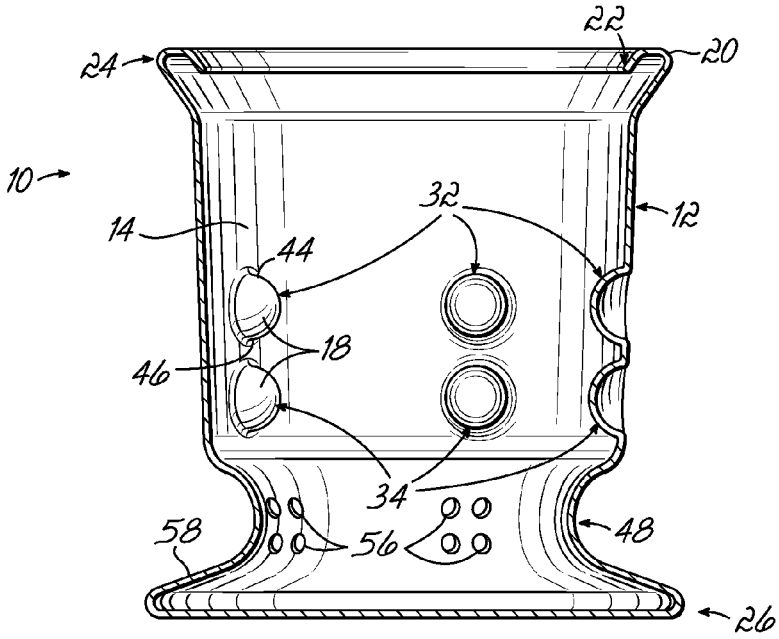
FIG. 3 is a cross-sectional view of the first embodiment of the plunger storage and transportation device of FIG. 1 taken along line 3-3 of FIG. 2.

Further, and referring to FIGS. 1, 2, and 3, the illustrated embodiment includes a plurality of indentations 18 associated with the side wall 14 of the housing 12. The plurality of indentations 18 assists in accepting and securing a plunger within the interior compartment 16 of the device 10. In the illustrated embodiment of the plunger storage and transportation device 10, each indentation 18 of the plurality of indentations 18 includes an arcuate surface 30. As will be described in greater detail below, as a plunger head is inserted into an interior compartment 16 of the device 10, the arcuate surface 30 of the indentations 18 may allow for greater ease of moving the plunger head, and particularly an outer edge portion thereof, past the plurality of indentations 18, in that the curvilinear shape of the arcuate surface 30 results in a protrusion into the interior compartment 16 that does not include any ledge perpendicular to the longitudinal axis of the device, which might act as a stop against the plunger head. However, as will be recognized by those of skill in the art, an arcuate surface 30 is not necessary to the present invention, and thus the indentations 18 may have other shapes. Further, as can be seen from the illustrated embodiment and as described above, the plurality of indentations 18 may be molded as a part of the cylindrical side wall 14 of the housing 12. However, as will be recognized by those of ordinary skill in the art, the indentations 18 do not need to be molded monolithically with the side wall 14 of the device 10, but rather may be a separate component that is affixed to the interior surface of the side wall 14 of the device 10.

In one embodiment, each indentation 18 of the plurality of indentations 18 may be coplanar with each of the other indentations 18 of the plurality of indentations 18. Thus, a plurality of indentations 18 may be spaced equidistant from one another and in the same plane around the circumference of the cylindrical side wall 14 of the illustrated embodiment. However, as will be apparent to those of ordinary skill in the art, it is not necessary that the indentations 18 that lie in the same plane be equidistant from one another about the interior surface of the side wall 14.

Additionally or alternatively, and referring particularly to FIGS. 1 and 3, the plurality of indentations 18 may include at least a first subset 32 of indentations 18 and a second subset 34 of indentations 18. In such an embodiment, each indentation 18 of the first subset 32 of indentations 18 is coplanar with each of the other indentations 18 of the first subset 32 of indentations 18 along a first plane, and each indentation 18 of the second subset 34 of indentations 18 is coplanar with each of the other indentations 18 of the second subset 34 of indentations 18 along a second plane, with the second plane not being coplanar with the first plane. Although not shown in the figures, there may be additional (i.e., third, fourth, fifth) subsets of indentations that each lie in their own planes, which are separate from the first and second planes. Further, as can be seen in the illustrated embodiment (see FIG. 2), there are five such indentations 18 located in one plane around the circumference of the side wall 14. However, as will be apparent to those of ordinary skill in the art, five is not a required number of indentations 18 to the invention, and there is no particular number of indentations which is necessary to the invention of the present application. Further, while a plurality of indentations is shown, it will be recognized by those skilled in the art that an indentation may be a continuous ring about the interior compartment.

Figure 4:
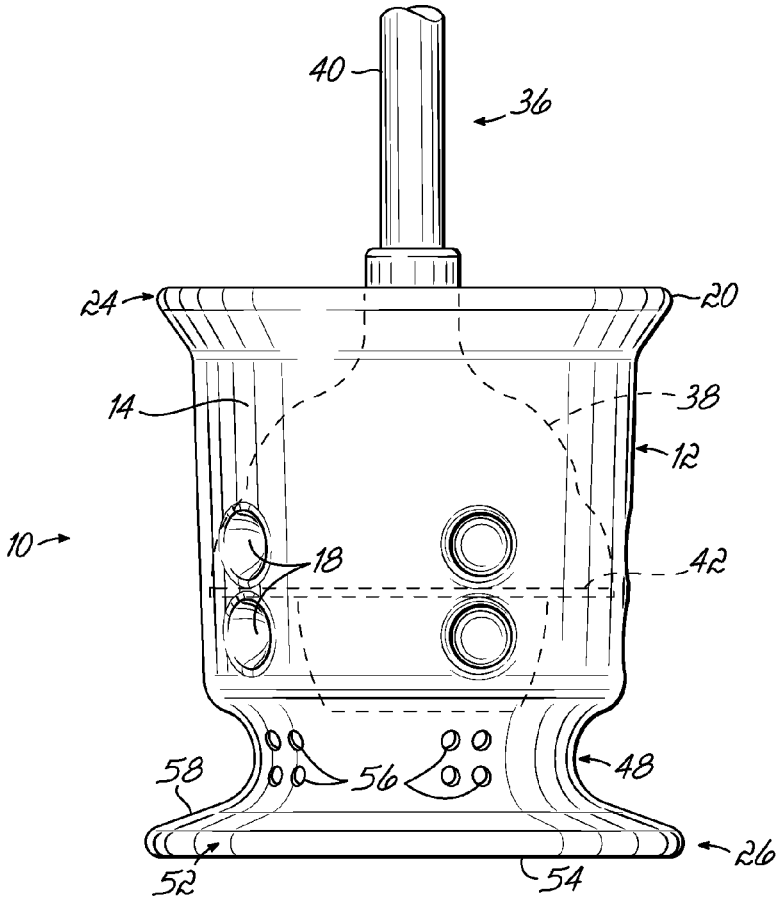
FIG. 4 is a side view of the first embodiment of the plunger storage and transportation device of FIG. 1 illustrating a plunger used in combination with the plunger storage and transportation device.

Referring now to FIG. 4, a plunger 36 is shown in combination with the first embodiment of the plunger storage and transportation device 10. As can be seen, the plunger 36 is positioned within the interior compartment 16 of the device 10, with the plunger head 38 being substantially surrounded by the side wall 14 of the device 10, and the elongate rigid handle 40 of the plunger 36 extending outwardly from the open first end 24 of the device 10. As the plunger head 38 is inserted into the device 10 through the open first end 24 thereof, a portion of the outer circumference or edge 42 of the plunger head 38 will eventually come into contact with the side wall 14 and/or at least some of the plurality of indentations 18 of the device 10. The illustrated embodiment of the device 10 in FIG. 4 includes first and second subsets 32, 34 of indentations 18, wherein the indentations 18 of the first subset 32 are coplanar with one another. When the plunger 36 in the illustrated embodiment of FIG. 4 is inserted into the interior compartment 16 of the device 10, the portion of the outer circumference or edge 42 of the plunger 36 will eventually come into contact with an upper portion 44 of some of the indentations 18. With a continued insertion force applied to the plunger 36 (i.e., a downward force in the illustrated embodiment), the flexible plunger head 38 will flex so as to push past those indentations 18. Once the portion of the circumference or edge 42 of the plunger head 38 has moved past the first subset 32 of indentations 18 in the illustrated embodiment, it will flex back to its substantially original shape, and be disposed beneath a lower portion 46 of the first subset 32 of indentations 18. In this position, the plunger 36 of the illustrated embodiment of FIG. 4 is held within the interior compartment 16 of the device 10 with sufficient force such that grasping the handle and lifting the plunger 36 will not be sufficient force to remove the plunger 36 from the interior compartment 16 of the device 10 (i.e., will not be sufficient to move it in an upward direction past the first subset 32 of indentations 18). Rather, the device 10 will lift with the plunger 36 such that the plunger 36 may be transported within the device 10.

While not illustrated, it will be appreciated by those of skill in the art that, alternatively, a plunger having a smaller circumference or sized plunger head than that illustrated in FIG. 4 could be inserted into the device 10 such that it would push past the second subset 34 of indentations 18 to be held within the device 10 (in the same manner as described above). Further, as will be recognized by those skilled in the art, while the plunger head 38 of the illustrated embodiment of FIG. 4 appears to be insinuated between the first subset 32 and second subset 34 of indentations 18, it is not necessary for such an insinuation to be present in order for the plunger 36 to be sufficiently held within the device 10. Finally, it will be recognized by those of skill in the art that while the first and second subset 32, 34 of indentations 18 in the illustrated embodiment are useful for helping to retain the plunger 36 within the device 10, the plunger 36 may also be held in the device 10 by a sufficient grip between the tapered side wall 14 and the plunger head 38 itself, or by both the tapered side wall 14 and indentations 18.

Referring to FIGS. 1, 3, and 4, proximal to the portion of the interior compartment 16 that is opposite the first end 24 of the housing 12, the side wall 14 curves inwardly in a concave shape 48 (in the illustrated embodiment) towards the longitudinal axis 28 of the housing 10. This region of the side wall 14 defines a drainage shaft 50 in the housing 12 that allows for drainage of any liquids or other substances introduced into the housing 12, and prevents pooling of the liquids and other substances in the interior compartment 16 of the housing 12. The drainage shaft 50 is fluidly connected to a base 52 of the device 10, which has a circular closed bottom surface 54 in the illustrated embodiment. The drainage shaft 50 connects the interior compartment 16 to the base 52, which allows for liquids, and other substances, to pool in the base 52. Because the liquids and other substances pool in the base 52, they can drain off of the plunger 36, out of the interior compartment 16, through the drainage shaft 50, and into the base 52. Thus, when the plunger 36 is removed from the device 10 for its next use, no liquids or other substances are removed from the device 10 along with the plunger 36. Further, the base 52 may include a drainage port (not shown in the illustrated embodiment), which can be opened or closed, and in an open position can be used to remove the liquids and other substances from the base 52.

Further, the side wall 14, at the area of the drainage shaft 50 (i.e., the concave portion in the illustrated embodiment) includes a plurality of ventilation openings 56. These ventilation openings 56 allow for airflow between the outside of the device 10 and the inside of the device 10 at or near the drainage shaft 50 to assist drying of the plunger 36, which further assists in reducing and preventing mildew and other contamination. In alternate embodiments, the ventilation openings 56 may also include filters (not shown in the illustrated embodiment). As an example, each of the ventilation openings 56 may be covered by or may contain an air permeable and water impermeable filter. Such a filter allows airflow between the outside and the inside of the device 10 in order to assist in drying of the plunger 36 and prevention of mildew and other contaminants, while not allowing the passage of water, other liquids, or other substances therethrough. Thus, any water or other substances contained in the base 52 would be prevented from spilling out of the ventilation openings 56.

Further, the base 52 of the device 10 provides a foot step region 58 that assists in removal of a plunger 36 from the device 10. In particular, the foot step region 58 provides enough space to allow a user to step on the base 52 of the plunger storage and transportation device 10 (with one or both feet). In particular, the concave shape 48 of the drainage shaft 50 (on the first embodiment) allows room for a user's foot to be placed on the base 52 while removing a plunger 36 from the device 10. The diameter of the foot step region 58 may be the same as the outwardly flared rim 20 at the top opening 22 of the device 10. As shown in the illustrated embodiment, the base 52 is circular. However, in alternate embodiments, squared-off edges may be included on the foot step region 58 located on opposing sides at 180 degrees, allowing for the plunger storage and transportation device 10 to be placed on its side in a horizontal position.

Referring now to FIGS. 5-13 (where like numbers are used to designate like components), a second embodiment of the plunger storage and transportation device 10 is shown. In this second embodiment, the device 10 includes a housing 12 having at least one side wall 14 defining an interior compartment 16, and an outer rim 20 defining an opening 22 at a first end 24 of the housing 12, wherein the at least one side wall 14 extends from the first end 24 toward a second end 26 of the housing 12, the second end 26 being opposite the first end 24; a plurality of lid retaining members 60 on the at least one side wall 14 and extending inwardly into the interior compartment 16 of the housing 12; and a flexible lid 62 adapted to confront at least two of the plurality of lid retaining members 60.

The housing 12, in the illustrated embodiment (as seen particularly in FIGS. 8, 9, and 12), has a side wall 14 that is open at the first end 24, and closed proximal the second end 26. Further, a portion of the side wall 14 that defines an interior compartment 16 is generally cylindrical (in the illustrated embodiment) and extends from the first end 24 in a direction toward the second end 26 for a distance which is sufficient to accommodate a variety of existing plunger products. The flexible lid 62 (see FIGS. 6, 9, 12, and 13) has a round, planar shape that is slightly smaller in diameter than the interior diameter of the housing 12. The lid retaining members 60 that position the lid 62 may be embodied as a lip or edge that runs around the interior compartment 16 of the housing 12 in a continuous manner. Alternatively, the lid retaining members 60 may be provided around the interior compartment 16 in a noncontinuous manner, such as tabs.

The lid position can be adjusted up or down within the housing 12, to accommodate the height of a wide variety of plunger devices. The plunger retaining lid 62 has a center opening 64 that is slightly larger than the diameter of a common plunger handle, through which the plunger handle 40 will protrude when the plunger 36 is in the stored position. The plunger retaining lid 62 may have a plurality of segments 66 that may be embodied as separate segments of flexible material, or may be connected along the edges by folds of excess material, which allows for the segments 66 to be urged downward and apart when the plunger 36 is being inserted into the housing 12, while maintaining a continuous seal that prevents any upward splashing of liquids during use or transport. The flexible lid 62 will have sufficient resistance to the insertion and removal of the plunger 36 so that a user is compelled to step on the foot step base region 52 of the housing 12 to hold the housing 12 in position while removing the plunger 36. This resistance will allow a user to pick up and carry the plunger 36 and the housing 12 as a single unit, by the plunger handle, without pulling the plunger 36 out of the housing 12.

Figure 5:
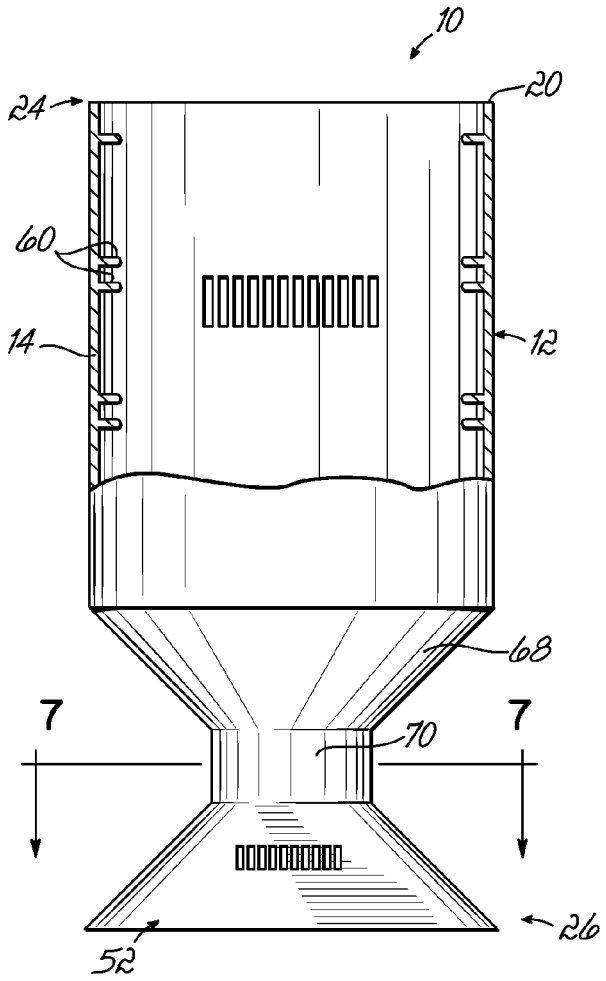
FIG. 5 is a side view in partial cross section of a second embodiment of a plunger storage and transportation device according to the principles of the present invention.
Figure 6:
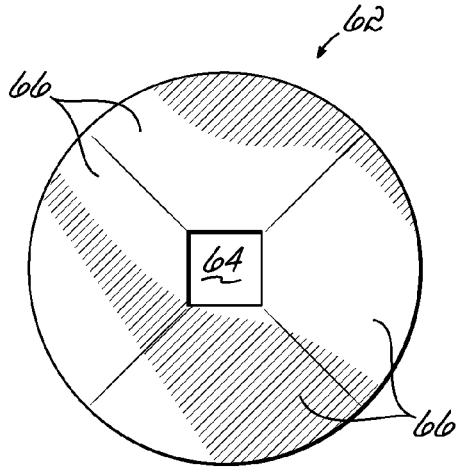
FIG. 6 is a top view of a plunger retaining lid used as part of the second embodiment of the plunger storage and transportation device of FIG. 5.
Figure 7:
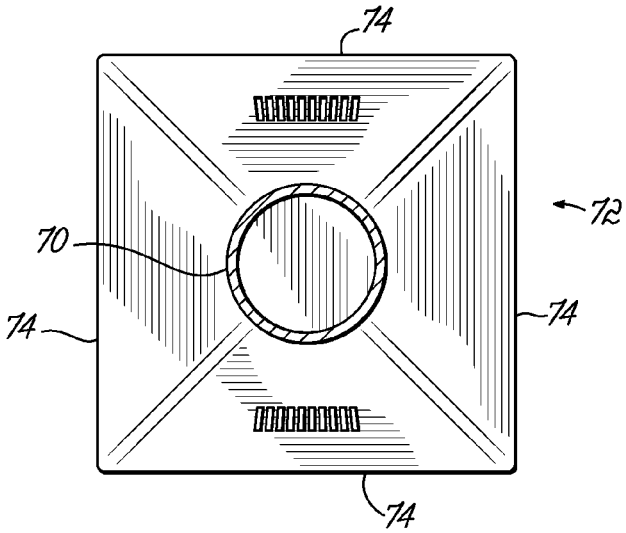
FIG. 7 is a cross-sectional view of the second embodiment of the plunger storage and transportation device of FIG. 5, taken along line 7-7 of FIG. 5.
Figure 11:
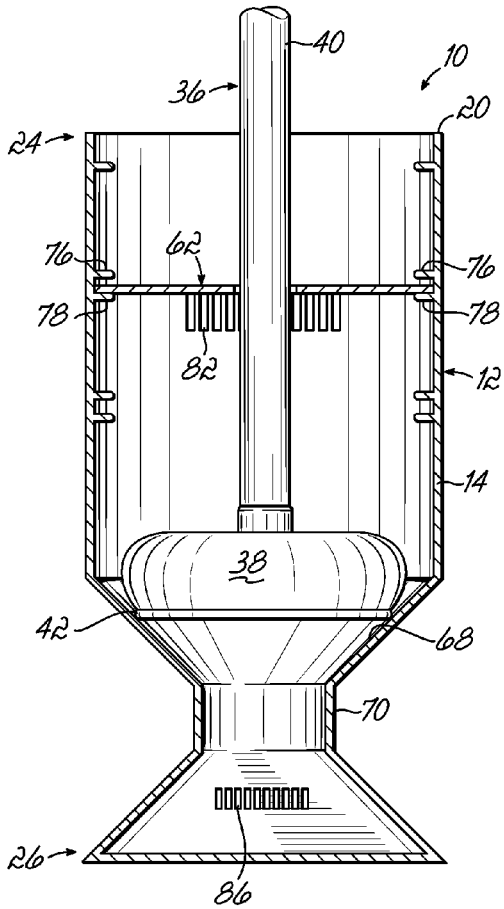
FIG. 11 is a cross-sectional view of the second embodiment of the plunger storage and transportation device, illustrating a common plunger inserted into the device.
Figure 12:
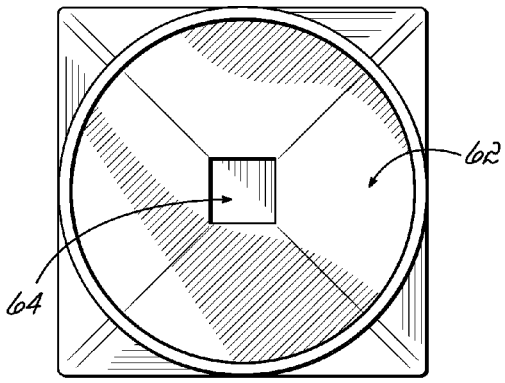
FIG. 12 is a top view of the second embodiment of the plunger storage and transportation device.
Figure 13:
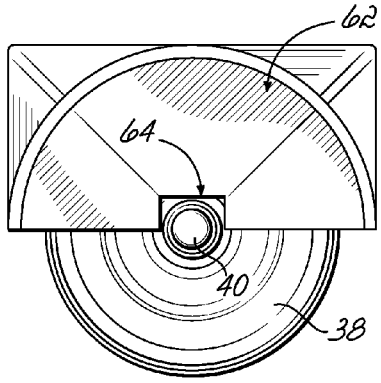
FIG. 13 is a top view of the second embodiment of the plunger storage and transportation device, illustrating the front half of the device removed and a plunger inserted into the device.

Referring now to FIGS. 5 and 11, the plurality of lid retaining members 60 can be seen in greater detail. In one embodiment of the present invention, each lid retaining member 60 of the plurality of lid retaining members 60 may be coplanar with each of the other lid retaining members 60 of the plurality of lid retaining members 60. Thus, the plurality of lid retaining members 60 may be spaced equidistant from one another and in the same plane around the circumference of the side wall 14 of the illustrated embodiment. However, as will be apparent to those of ordinary skill in the art, it is not necessary that the lid retaining members 60 that lie in the same plane be equidistant from one another about the interior surface of the side wall 14. Further, as can be seen from the illustrated embodiment, the plurality of lid retaining members 60 may be molded as a part of the side wall 14 of the housing 12. However, as will be recognized by those of ordinary skill in the art, the lid retaining members 60 do not need to be molded monolithically with the side wall 14 of the device 10, but rather may be a separate component that is affixed to the interior surface of the side wall 14 of the device 10.

Additionally or alternatively, the plurality of lid retaining members 60 may include at least a first subset 76 of lid retaining members 60 and a second subset 78 of lid retaining members 60. In such an embodiment, as illustrated in FIGS. 5 and 11, each lid retaining member 60 of the first subset 76 is coplanar with each of the other lid retaining members 60 of the first subset 76 along a first plane, and each lid retaining member 60 of the second subset 78 is coplanar with each of the other lid retaining members 60 of the second subset 78 along a second plane, wherein the second plane is not coplanar with the first plane. Thus, with particular reference to FIG. 11, the first and second subsets 76, 78 of lid retaining members 60 are positioned such that the outer circumference of the lid 62 can be insinuated between the first subset 76 and second subset 78 of lid retaining members 60 in order to hold the lid 62 at varying heights along the side wall 14 of the device 10. Further, there may be additional (i.e., third, fourth, fifth, sixth) subsets of lid retaining members 60 that each lie in their own planes, which are separate from the first and second planes.

Figure 9:
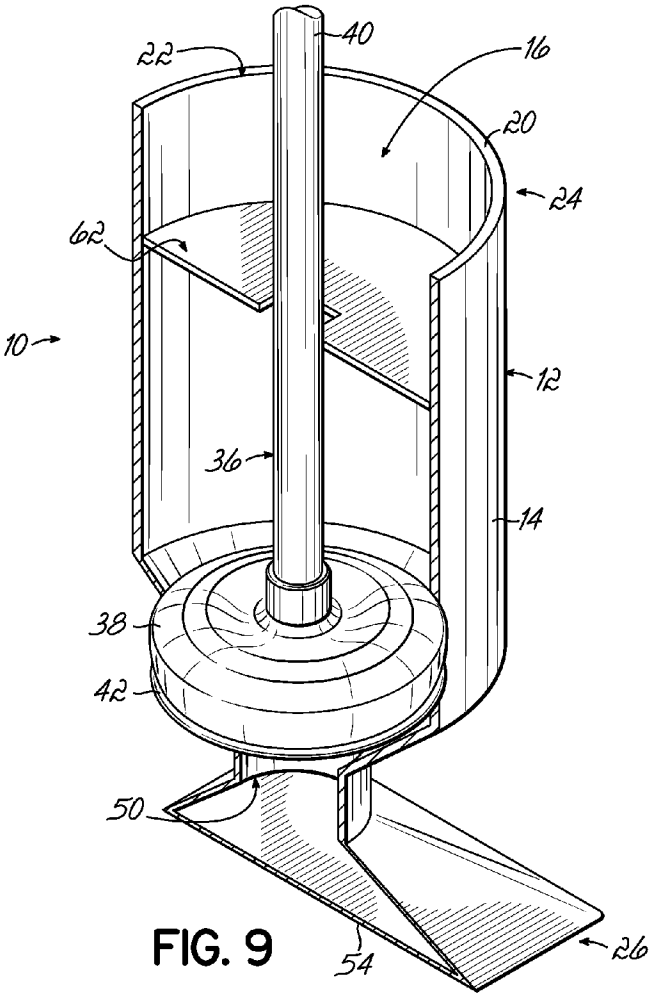
FIG. 9 is a cross-sectional view of the second embodiment of the plunger storage and transportation device, taken along line 9-9 of FIG. 8, and illustrating a plunger inserted into the device.
Figure 8:
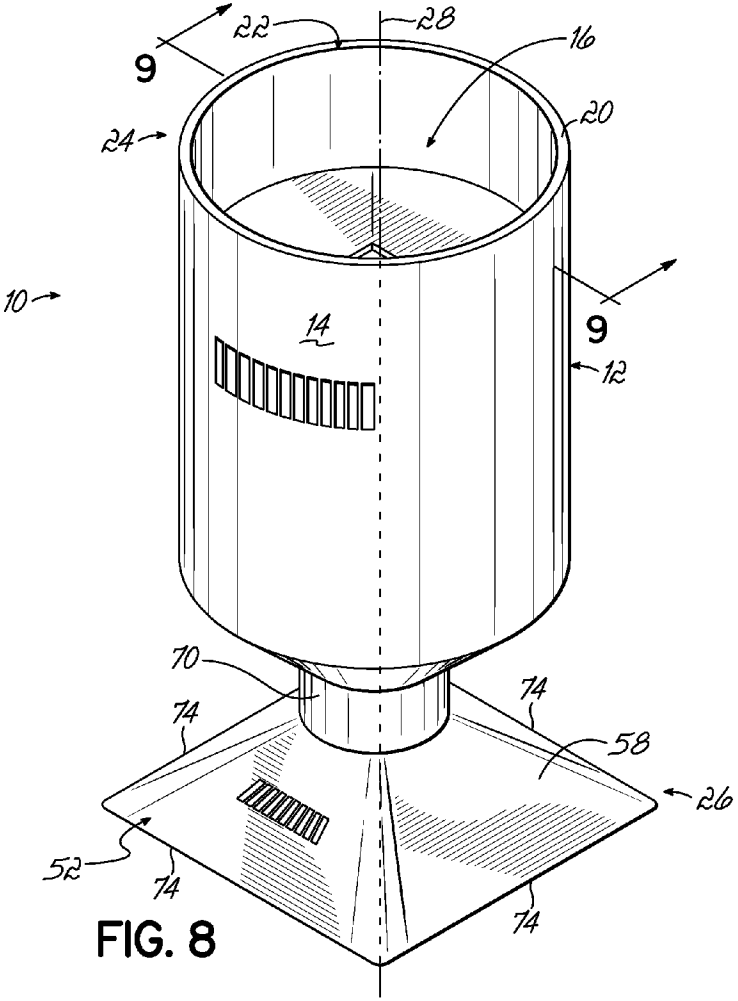
FIG. 8 is a perspective view of the second embodiment of the plunger storage and transportation device according to the present invention.
Figure 10:
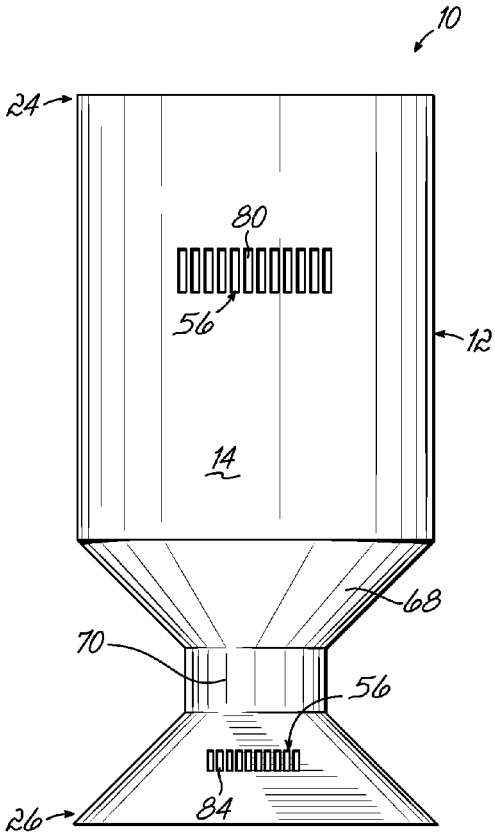
FIG. 10 is a side view of the second embodiment of the plunger storage and transportation device according to the present invention.

Thus, and referring now to FIGS. 9 and 11, a plunger 36 is shown in combination with the second embodiment of the plunger storage and transportation device 10. As can be seen, the plunger 36 is positioned within the interior compartment 16 of the device 10, with the plunger head 38 being substantially surrounded by the side wall 14 of the device 10, and the elongate rigid handle of the plunger 36 extending outwardly from the open first end of the device 10. As the plunger head 38 is inserted into the device 10 through the open first end thereof, the plunger head 38 may eventually contact the side wall 14 or will eventually contact a lower region of the interior compartment 16, thereby defining the maximum distance that the plunger head 38 can be inserted into the device 10. Once in this position, the lid 62 is then positioned relative to the plunger 36 with the elongate and rigid handle of the plunger 36 extending through the central orifice 64 of the lid 62. The lid 62 is then pressed downwardly into the interior compartment 16 until it engages between first and second subsets 76, 78 of lid retaining members 60. In particular, as the lid 62 is pressed down, it is either flexible and/or segmented, and so can move around the top surface of the first subset 76 of lid retaining members 60 in order to insinuate between the first and second subset 76, 78 of lid retaining members 60. The lid retaining members 60 are intended to locate and secure the position of the plunger retaining lid 62, and are disposed at the interior surface of the cylindrical vertical wall 70 of the housing 12, and may be arrayed in a variety of patterns around the interior 16 of the housing 12 to locate and secure the lid 62 into position.

Those skilled in the art will recognize that alternate methods of attaching, affixing, or securing into position the plunger retaining lid may be used, including, but not limited in use to, screws, bolts, resistive notches, clips, clasps, and other methods of attaching, affixing, or securing well known to those skilled in the art.

Proximal to the portion of the interior compartment 16 that is opposite the first end 24 of the housing 12, the side wall 14 includes a tapering component 68 that tapers toward the longitudinal axis 28 of the housing 12 for a distance which is less than the radius of the housing 12, at an angle which, in the illustrated embodiment, is less than 90 degrees, thereby creating a funnel shape at the interior of the housing 12, which will allow for drainage and prevent pooling of liquids that may be introduced into the interior compartment 16 of the housing 12. Beneath the tapered component 68 (i.e., opposite the interior component 16), the side wall 14 then extends downward a distance, in a manner which is parallel to the main cylindrical housing 12 (in the illustrated embodiment), thereby creating a vertical cylindrical wall 70, which is smaller in diameter than the housing 12 defining the interior compartment 16. This defines a drainage shaft 50 in the housing 12 that allows for drainage of any liquids or other substances introduced into the housing 12 and prevents pooling of the liquids and other substances in the interior compartment 16 of the housing 12. The vertical cylindrical wall 70, and thus the drainage shaft 50, connects to a base 52, which, in the illustrated embodiment, has a square planar bottom surface 72, and four planar side surfaces 74 that extend upward from the bottom surface 72 and inward towards the center of the housing 12 at an angle which is less than 90 degrees. The drainage shaft 50 connects the interior compartment 16 to the base 52, which allows for liquids, and other substances, to pool in the base 52. Because the liquids and other substances pool in the base 52, they can drain off the plunger 36, out of the interior compartment 16, through the drainage shaft 50, and into the base 52. Thus, when the plunger 36 is removed from the device 10 for its next use, no liquids or other substances are removed from the device 10 along with the plunger 36. Further, the base 52 may include a drainage port (not shown in the illustrated embodiment), which can be opened or closed, and in an open position, can be used to remove the liquids and other substances from the base 52.

The housing 12 includes one or a plurality of ventilation openings 56 that allow for air displacement to occur, thereby reducing the collection of unpleasant odors within the housing 12. First and second ventilation openings 80, 82, in the illustrated embodiment, are disposed at the side wall surface of the housing 12 on opposing sides of the housing 12 proximal to the interior compartment 16. Third and fourth ventilation openings 84, 86 are disposed at the angled planar side surfaces 74 of the drainage base 52 and foot step region 58 on opposing sides of the unit. In alternate embodiments, the ventilation openings 56 may also include filters (not shown in the illustrated embodiment). As an example, each of the ventilation openings 56 may be covered by or may contain an air permeable and water impermeable filter. Such a filter allows airflow between the outside and the inside of the device 10 in order to assist in drawing plunger 36 and prevention of mildew and other contaminants, while not allowing the passage of water, other liquids, or other substances therethrough. Thus, any water or other substances contained in the base 52 would be prevented from spilling out of the ventilation openings 56.

It will be understood by those skilled in the art that many of the features of the illustrated first and second embodiments of the plunger storage and transportation device 10 are merely exemplary. For example, while the figures depict the device 10 being used in an upright position, the device 10 may be designed for use in either a vertical upright position, or in a horizontal, or lying-down position. Further, alternate embodiments of the invention may comprise a housing 12 having a variety of different shapes, such as triangular, rectangular, octagonal, oval, semicircular, and other shapes not referred to herein.

Those skilled in the art will further recognize that the sizes, such as overall height and width of the device 10, may be embodied to suit specific type or styles of plumbing plungers while performing the use and function disclosed herein.

Further, the present invention may be made of a variety of a materials that allow the product to perform the function disclosed herein, including but not limited in use to, metals such as stainless steel, steel, aluminum, as well as synthetic or semisynthetic polymerization products or plastics, rubbers, recycled materials, and other materials well known to those skilled in the art.

Additionally, while the figures depict a particular number of ventilation openings 56 in the first and second embodiments, those skilled in the art will understand that alternate embodiments of the invention may comprise fewer or more ventilation openings that may be embodied in a variety of sizes and shapes to allow for proper ventilation of the unit during use.

Further, in alternate embodiments, the device 10 may comprise features that will act to alter the odor or bacteria levels in and around the invention during use or nonuse periods, including scented features that may be embodied as a spray, tablet, or scented pad that is placed inside, or affixed to, the interior 16 of the housing 12 or the drainage region 50 of the base 52 and will act to continuously or periodically release a scent or fragrance into the air to alter, mask or cover the odors within and around the plunger container, thereby acting as a deodorizer.

Further, the device may include ultraviolet lights at the interior of the housing 12 which will act to kill bacteria at the interior of the main body housing 12 or drainage region 50 of the invention in a continuous or periodic manner by allowing the user to turn on and off the ultraviolet light feature as desired, or by emitting a burst or quantity of ultraviolet light into the interior environment as directed by the user by means of a variety of switches or buttons that may be hand or foot operated.

While the present invention has been disclosed by reference to the details of preferred embodiments of the invention, it is to be understood that the disclosure is intended as an illustrative rather than in a limiting sense, as it is contemplated that modifications will readily occur to those skilled in the art, within the spirit of the invention and the scope of the amended claims.

The invention claimed is:

1. A combination comprising:

(a) a plunger storage and transportation device comprising:

(i) a housing having one or more side walls defining an interior compartment, and an outer rim defining an opening at a first end of the housing, wherein the one or more side walls extend from the first end of the housing toward a second end of the housing, the second end being opposite the first end; and (ii) a first set of indentations associated with the one or more side walls and extending inwardly into the interior compartment of the housing and a second set of indentations associated with the one or more side walls and extending inwardly into the interior compartment of the housing, the first and second sets of indentations being spaced apart from one another;

wherein each indentation of the first set of indentations is coplanar with each of the other indentations of the first set of indentations along a first plane, and wherein each indentation of the second set of indentations is coplanar with each of the other indentations of the second set of indentations along a second plane, the first and second planes being substantially parallel to one another; and (b) a plunger associated with the plunger storage and transportation device, wherein a portion of the plunger has a width that is greater than:

(i) a footprint of the interior compartment defined by the spacing of the first set of indentations, or (ii) a footprint of the interior compartment defined by the spacing of the second set of indentations, and the portion of the plunger is positioned:

(i) between the first set of indentations and the second set of indentations, or (ii) between the second set of indentations and the second end of the housing.

2. The combination of claim 1, wherein each indentation of the first set of indentations and the second set of indentations includes an arcuate surface.

3. The combination of claim 1, wherein the device further comprises a lower side wall extended downward, in a manner which is away from the open first end of the housing, thereby creating a wall which is smaller in a cross-sectional footprint than the housing.

4. The combination of claim 3, further comprising at least one ventilation opening disposed in and defined by the lower side wall.

5. The combination of claim 1, wherein the device further comprises a planar foot pedestal bottom surface.

6. The combination of claim 5, wherein the planar foot pedestal bottom surface is squared-off.

7. The combination of claim 1, wherein the outer rim of the housing is outwardly flared.

8. The combination of claim 1, wherein the one or more side walls of the housing taper inwardly from the first end of the housing toward the second end of the housing.

* * * * *

UNITED STATES PATENT AND TRADEMARK OFFICE

CERTIFICATE OF CORRECTION

PATENT NO. : 7,861,859 B2
APPLICATION NO. : 12/249146
DATED : January 4, 2011
INVENTOR(S) : Rob Reynolds et al.

It is certified that error appears in the above-identified patent and that said Letters Patent is hereby corrected as shown below:

Column 2,
Line 28, “plunges” should be --plungers--.
Line 20, “plunges” should be --plungers--.

Column 10,
Line 66, “type” should be --types--.

Signed and Sealed this
Third Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,861,859 B2
APPLICATION NO. : 12/249146
DATED : January 4, 2011
INVENTOR(S) : Rob Reynolds et al.

It is certified that error appears in the above-identified patent and that said Letters Patent is hereby corrected as shown below:

Column 2,
Line 18, “plunges” should be --plungers--.
Line 20, “plunges” should be --plungers--.

Column 10,
Line 66, “type” should be --types--.

This certificate supersedes the Certificate of Correction issued May 3, 2011.

Signed and Sealed this
Twenty-third Day of August, 2011

David J. Kappos

David J. Kappos
*Director of the United States Patent and Trademark Office*